US011614100B2

(12) United States Patent
Vergara Alarcón

(10) Patent No.: US 11,614,100 B2
(45) Date of Patent: Mar. 28, 2023

(54) MECHANICAL IMPULSE MOTOR BY COMPRESSED AIR COMPRESSION

(71) Applicant: Demóstenes Jesús Vergara Alarcón, Santiago (PA)

(72) Inventor: Demóstenes Jesús Vergara Alarcón, Santiago (PA)

( * ) Notice: Subject to any disclaimer, the term of this patent is extended or adjusted under 35 U.S.C. 154(b) by 0 days.

(21) Appl. No.: 17/392,245

(22) Filed: Aug. 2, 2021

(65) Prior Publication Data

US 2023/0035542 A1 Feb. 2, 2023

Related U.S. Application Data

(63) Continuation-in-part of application No. 16/628,255, filed on Jan. 2, 2020, now abandoned.

(51) Int. Cl.
*F15B 11/16* (2006.01)

(52) U.S. Cl.
CPC ..... *F15B 11/16* (2013.01)

(58) Field of Classification Search
CPC . F15B 11/16; F03G 7/10; F16D 31/02; H02K 53/00
See application file for complete search history.

(56) References Cited

U.S. PATENT DOCUMENTS 4,057,039 A * 11/1977 Pinto ..... F01C 1/073 123/43 B
4,124,978 A * 11/1978 Wagner ..... F01B 1/0655 92/162 R
2011/0308241 A1* 12/2011 Huff ..... B60K 6/12 29/888.011

* cited by examiner

*Primary Examiner* — Abiy Teka
*Assistant Examiner* — Daniel S Collins
(74) *Attorney, Agent, or Firm* — Noli IP Solutions PC

(57) ABSTRACT

Disclosed is a mechanical impulse motor for producing kinetic rotational energy by driving one or more pulleys using compressed air comprising: an air compressor powered by an electric battery; two pneumatic pistons configured to receive compressed air from the air compressor; two lever arms each of which driven by one of the pneumatic pistons; two ratchets each of which driven by one of the level arms; a shaft securely connected to the two ratchets, the shaft being driven by the lever arms to rotate in a direction constrained by the two ratchets; and a pulley securely connected to the shaft.

4 Claims, 8 Drawing Sheets

MECHANICAL IMPULSE MOTOR BY COMPRESSED AIR COMPRESSION

CROSS REFERENCE TO THE RELATED APPLICATIONS

The present application is a Continuation-In-Part (CIP) of Non-Provisional application Ser. No. 16/628,255 filed on Jan. 2, 2020, the entire contents of which is incorporated herein by reference.

FIELD OF INVENTION

This invention relates to the field of mechanical engines, and more specifically to a mechanical impulse engine without the need of using the hydrocarbons.

BACKGROUND OF THE INVENTION

Using hydrocarbons to move compressors, generators or water pumps create several problems. Especially the generation of clean, non-polluting energy is a global demand to improve the environment. More precisely most engines are designed but are dependent on fossil fuels, something that increases pollution every day.

The previous art are inventions that do not contain a start mechanism with compressed air, for example, the invention US201130766 is an electric generator consisting of elements of revolution, with a main turning axis and radial arms. However, the prior art does not use ratchets and the same mechanism.

BRIEF SUMMARY OF THE INVENTION

The invention provides a mechanical impulse motor driven by compressed air provided by a compressor. The mechanical impulse motor drives an alternator to recharge a battery, and in the continuity of pulleys connected to a generator which produces clean energy.

An objective of the invention is to provide a well water pumping system. Another objective of the invention is to provide an engine that replaces the existing conventional diesel, gasoline or any other hydrocarbon engine and thus move generator rotors and produce clean energy.

The energy capacity produced by commercial generators powered by the mechanical impulse motor depends on the dimensions of the elements that make up it.

It should be noted in the mechanical impulse motor, the body of the pneumatic piston is enclosed in a metallic lining that pivots and thus does not lose momentum when the piston fires or retracts. Another objective of the invention is to provide an ecological, environmentally friendly and low-cost system.

BRIEF DESCRIPTION OF DRAWING

So that the present disclosure can be understood by those of ordinary skill in the art, a more detailed description can be had by reference to aspects of some illustrative embodiments, some of which are shown in the accompanying drawings.

DETAILED DESCRIPTION OF THE INVENTION

Figure 1:
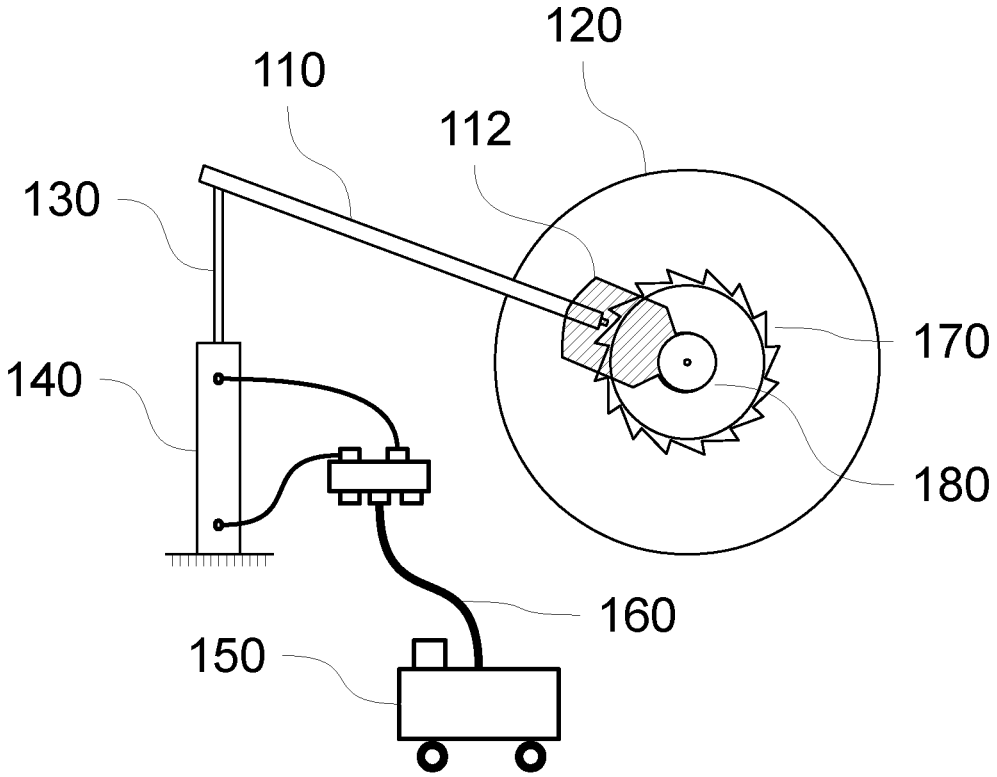
FIG. 1 illustrates a mechanical impulse motor, in accordance with some embodiments.
Figure 2:
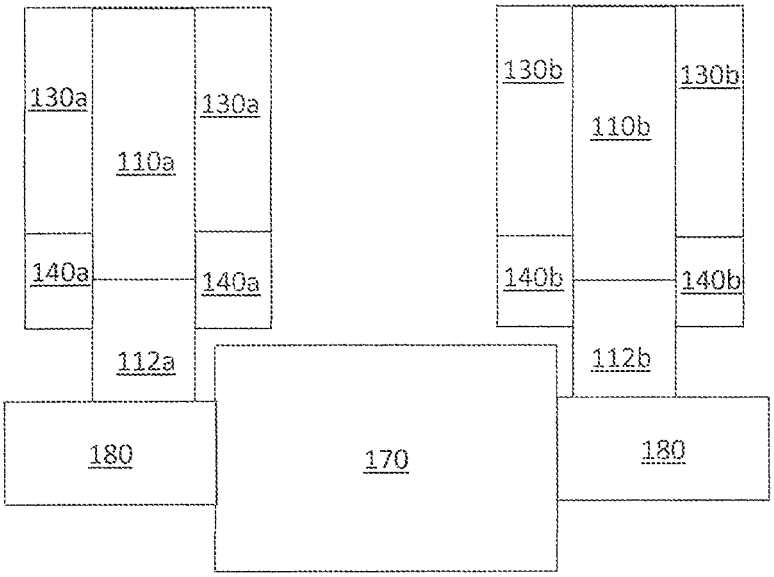
FIG. 2 illustrates a mechanical impulse motor, in accordance with some embodiments.
Figure 3A:
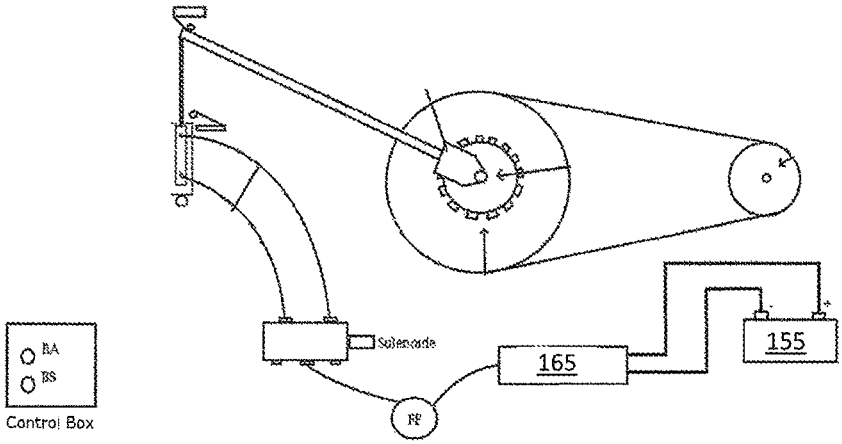
FIGS. 3A-3C illustrate a mechanical impulse motor, in accordance with some embodiments.
Figure 3C:
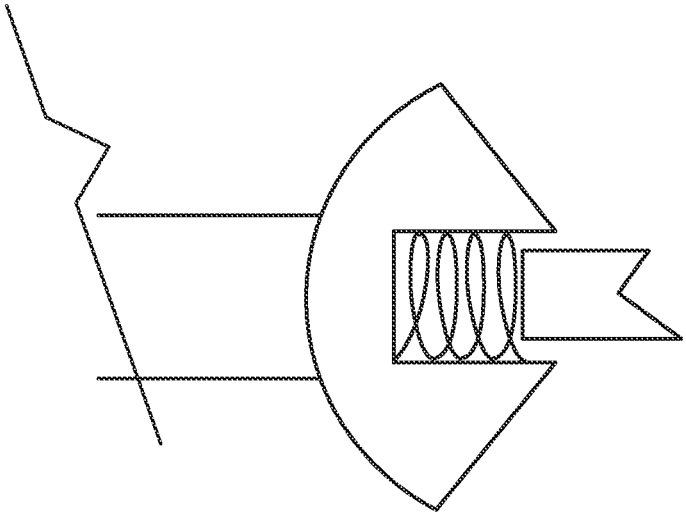
Figure 3B:
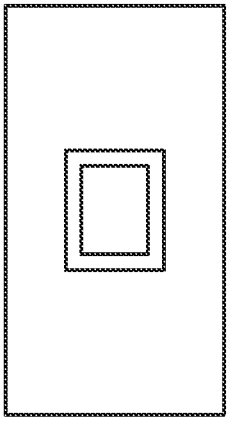
Figure 4:
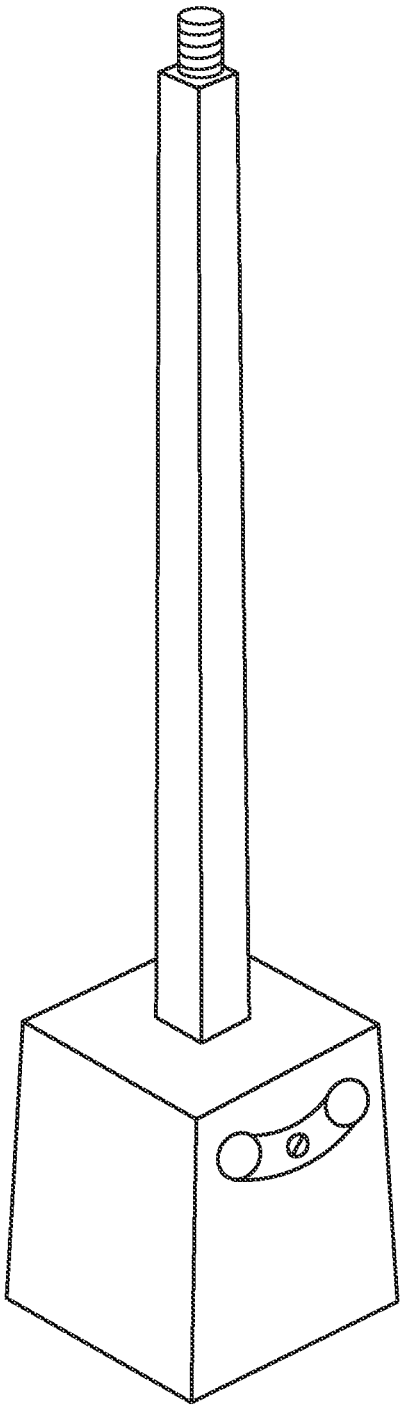
FIG. 4 illustrates a mechanical impulse motor, in accordance with some embodiments.
Figure 5:
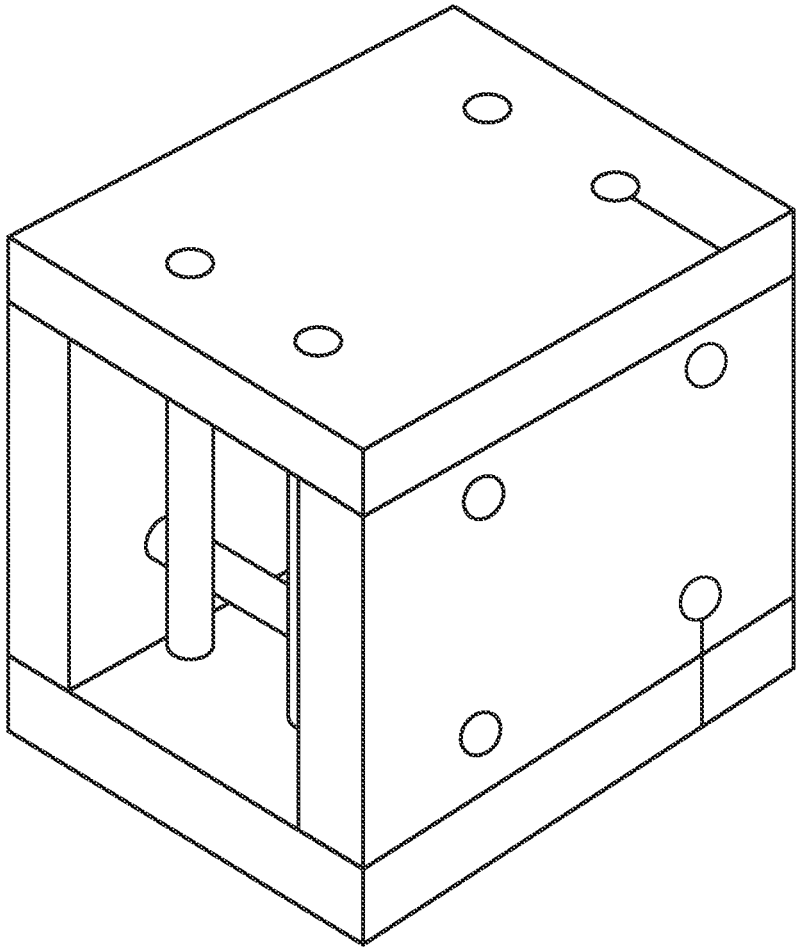
FIG. 5 illustrates a mechanical impulse motor, in accordance with some embodiments.
Figure 6:
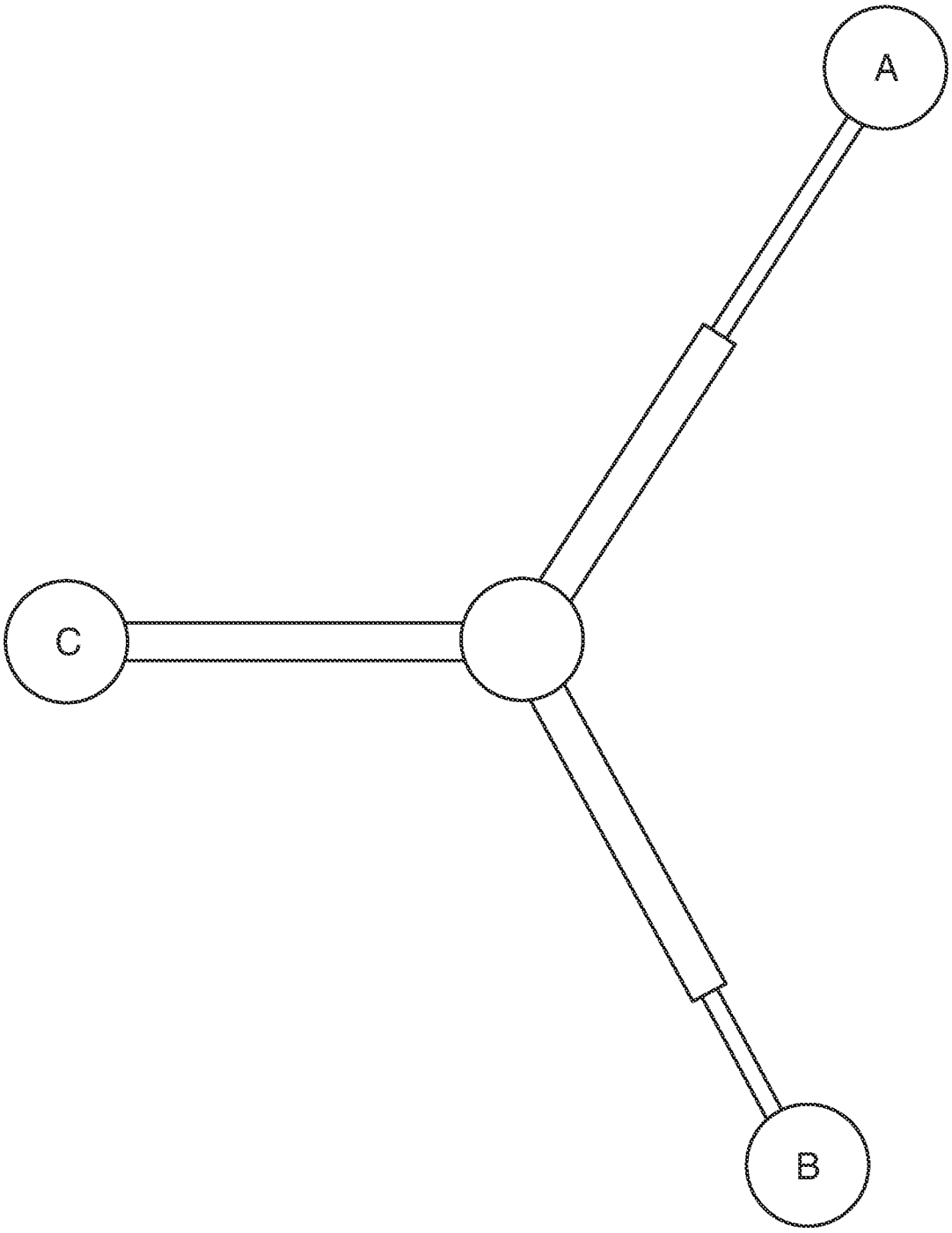
FIG. 6 illustrates a mechanical impulse motor, in accordance with some embodiments.
Figure 7:
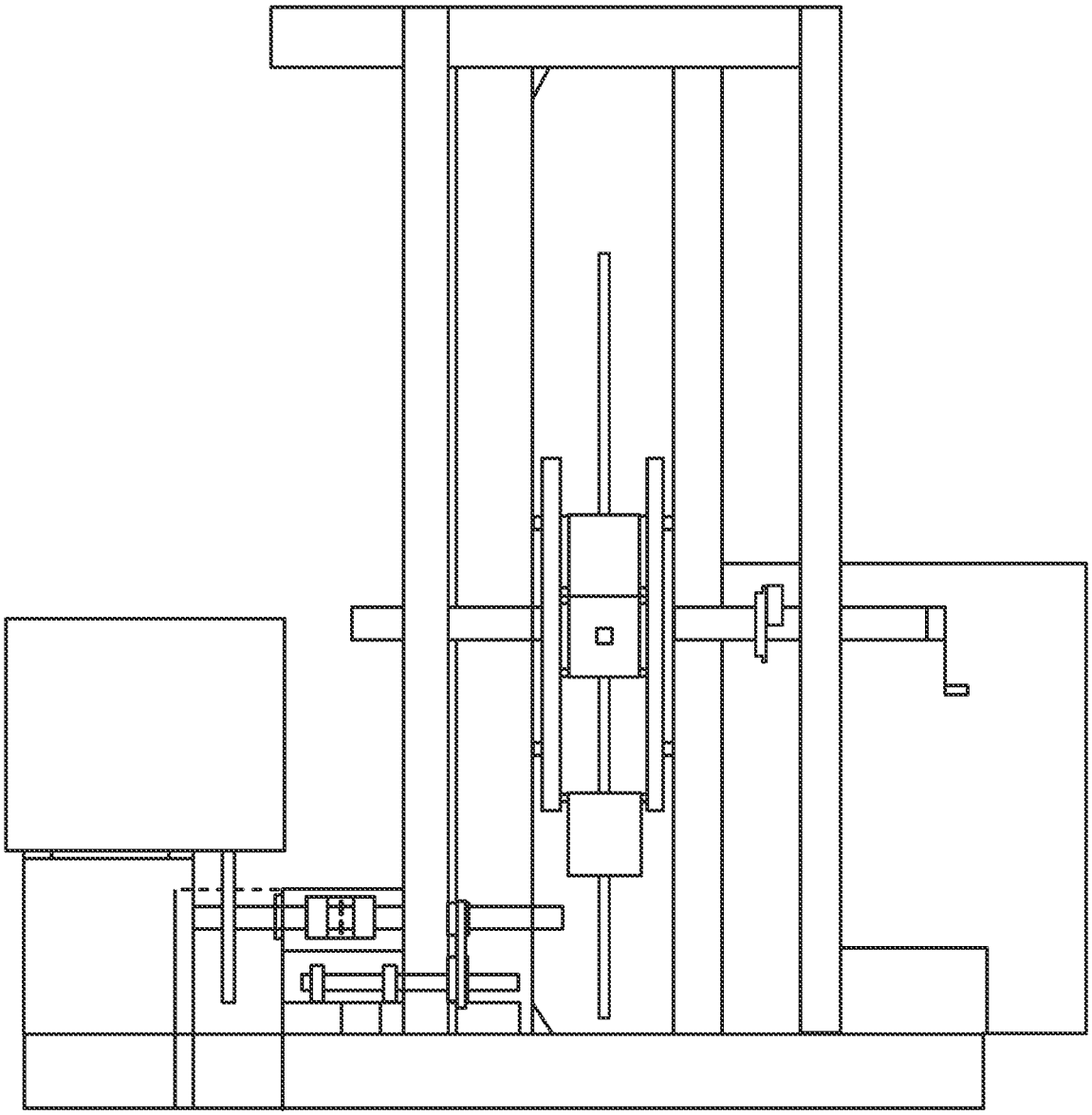
FIG. 7 illustrates a mechanical impulse motor, in accordance with some embodiments.

The invention provides a mechanical impulse motor by compression of compressed air. FIGS. 1-7 represent components of the mechanical motor according to the invention. FIG. 2 illustrate a front view of the mechanical motor, according to some embodiments. FIG. 3 illustrate a side-view of the mechanical motor connected to an alternator 165 which recharges a battery 155. The alternator may include an inverter (not shown).

Disclosed herein is a mechanical impulse motor which works by means of compressed air compression. The motor is driven at its initial base by a compressor with the power of about 3,000-watt inverter that sends compressed air to two pistons. The pistons in turn produce tow coupled forces to load two lever arms, which may be coupled together. The arms may be coupled to a main axis and a central axis, thus ensuring continuous rotation to a set of pulleys which act as an RPM multiplier. The mechanical impulse motor can be coupled to any suitable generator, water pump, or compressors, without having to use any type of fuel. The present invention attempts to solve the problem of running fossil-fuel consuming engines, by providing a means of starting the mechanical impulse motor with only an initial pulse of compressed air.

The rotation of a central shaft is driven by two ratchets 112 (located on each side of the wheel, shown as 112*a* and 112*b* in FIG. 2), two lever arms of 1 meter-long 110 (connected to each ratchet, located on each side of the wheel, shown as 110*a* and 110*b* in FIG. 2), each arm being driven by a pneumatic piston 140 (connected to each lever arm, located on each side of the wheel, shown as 140*a* and 140*b* in FIG. 2) having a travel of 30 mm. Each piston 140*a* and 140*b* may be powered by a 1 HP compressor 150. Alternatively, a 1 HP compressor 150 may power both pistons 140*a* and 140*b*. Each ratchet is driven by a piston, more the shaft by 60 mm, which has coupled to a 24-inch pulley; in its final portion it is connected to a set of pulleys, until it reaches 1800 rpm. An alternator is connected to one of the pulleys, and the alternator charges a battery. The battery is connected to an inverter from 12 V to 110, which in turn provides energy to the air compressor 150, which feeds the pneumatic pistons with 140 psi, causing rotation of this shaft of 60 mm and ensuring continuity of its permanent rotation. The shaft may be coupled through its sets of pulleys to any generator, water pump or compressor, without the need to use any kind of fuel such as gas, diesel, petrol, sun, water, wind, etc. 110 illustrates a torque lever attached at one end to the mechanism 112 containing the attack wedge. 112 illustrates a mechanism containing a wedge that when rotated clockwise attacks the wheel teeth 170 and in the anti-clockwise direction of the clock it slides.

120 Illustrates a concentric pulley with the sprocket 170.

130 Illustrates a piston that attaches at one end to the torque lever 110.

150 Illustrates an air compressor that feeds the chambers of the pneumatic pistons.

160 illustrates an, air compressor that feeds the chambers of the pneumatic pistons.

170 It illustrates a sprocket driven by an attack wedge.

180 illustrates a steel shaft.

Thus, a mechanical impulse motor by compression of compressed air. The mechanical impulse motor characterized in that it comprises two (2) pneumatic pistons. The mechanical impulse motor characterized in that it comprises two (2) levers of one (1) meter. The mechanical impulse motor characterized in that it comprises a compressor of 1 HP. The mechanical impulse motor characterized in that it comprises: one (1) inverter of 12 V BC and 3000 W, which drives an alternator to recharge a battery, and in the continuity of the pulleys-connected to a generator which produces clean energy.

An aspect of the present invention is to solve the problem of running engines by means of fuel. Another aspect of the present invention is to provide a means of starting engines with only an initial pulse of compressed air.

In some embodiments, a mechanical impulse motor is disclosed which utilizes compressed air compression. The mechanical impulse motor includes two pneumatic pistons, two lever arms, a compressor, and a touch reduction box. In some embodiments, the mechanical impulse motor includes two long-stroke electric actuators. The mechanical motor is driven at its initial base by a compressor. The compressor may be powered by a 3,000-watt inverter that sends compressed air to two pistons which produce an advantage of force at load of the lever arms. As can be seen on FIG. 3, the lever arms are coupled to a main and a central axis, thus ensuring continuous rotation of a set of pulleys. The pulleys act as RPM multipliers. The mechanical impulse motor creates an opportunity to be coupled to any suitable generator, water pump, or compressor, without having to use any type of fuel.

The mechanical impulse motor operates via rotation of the central axis which moves by two ratchets with two lever arms. Each lever arm is one meter long. The mechanical impulse motor is driven by a pneumatic piston that moves 30 millimeters. The compressor has 1 HP power, and the ratchets, when driven by the pistons, move the 60-millimeter in diameter shaft. Each 24-inch pulley is attached at an end of the shaft. In other words, the shaft is connected to a set of pulleys that reach 1800 RPM.

In some embodiments, an alternator is connected to one of the pulleys, to charge a battery. The battery is connected to a 12 volt to 110-volt inverter, to provide power for the air compressor. The compressor feeds the pneumatic pistons with compressed air at 140 PSI, thus ensuring the continued and permanent rotation of the 60 mm shaft. The shaft, via the set of pulleys, can be coupled to any suitable generator, water pump, or compressor. As such, the shaft does not use any type of fuel such as gas, diesel, gasoline, water, sun, winds, etc.

In some embodiments, when each of the pistons is driven with compressed air, the compressed air only contacts with one face of the piston. In some embodiments, one or more electrical valves are used for the inlet air to the cylinder and the outlet air to the cylinder.

In some embodiments, there is a reserve tank for the start and execution of the operation of the mechanical impulse motor.

In some embodiments, the mechanical impulse motor includes other components such as gears, ball bearings, covers, rails, etc.

A 12-volt inverter may be connected to a 1000A gel-type battery. The inverter converts from 12 volts to 110 and provides the power to the compressor for the initial execution of the entire mechanical impulse motor. The compressor sends air to two pistons, that are coupled to a centric axis. The pistons move (i.e., by approaching and moving away from the center of the main axis) the weights that each one carries.

The weights displaced and retracted by the pistons rotate circularly through a rail-type channel and do not give resistance to the pistons so that the pistons can make their proper operation effectively and without friction.

Each piston with its weight has a long-distance electrical sensor system which synchronizes the position and distance of each one to the main axis, so that in its initial impulse the inertia is broken and the required rotation speed of the axis is achieved.

The main, or centric, shaft is coupled to a gear set that acts as an rpm multiplier. A second shaft may be coupled to the gear set which governs and maintains the required rpm (e.g., 1500). The mechanical impulse motor can be coupled to another system or motor (e.g., Water Pump, Sugarcane Chopper, Rice Pill, Generator) via the second shaft.

The rotation of the mechanical impulse motor is initiated by the compressed air compressor which is adapted to a sensorial and precision electrical system, which leads the motor to break the inertia to the required rpm level (e.g., 5000, 8000, 12000 rpm). In cases where less rpm is required (e.g., 1500 rpm), once the inertia is broken, the compressor stops and the mechanical impulse motor maintains its rotation cycle for a certain time on its primary or main shaft, while the secondary shaft maintains its rotation speed (e.g., 1,500 rpm).

Once the main shaft reduces the rpm and equals the rpm of the secondary shaft, the mechanical impulse motor restarts and the compressor drives the pistons one more time.

The mechanical impulse motor does not keep the compressor running, which results in a greater utility advantage.

The generator rotor handling system works because of a jet of compressed air that activates the pneumatic pistons, these in turn, drive the ends of the torque levers (BB), which execute the ratchet mechanism. The ratchet mechanism engages a pulley set, which increases RPM, without greatly minimizing the magnitude of torque. The pulley coupled to the generator shows the magnitude of the RPM and torque variables necessary for its efficient operation. The metallic lining encloses the body of the pneumatic piston so that the pistons do not lose functionality due to impulse when the piston moves. The ratchet mechanism is configured to function continuously and not intermittently like traditional ratchets, due to its design synchronized by the deviations of the torque levers. The multiplier box multiplies the RPM.

What is claimed is:

1. A mechanical impulse motor for producing kinetic rotational energy by driving one or more pulleys using compressed air, comprising:

an air compressor powered by an electric battery;

two pneumatic pistons configured to receive compressed air from the air compressor;

two lever arms each of which is driven by one of the pneumatic pistons;

two ratchets each of which is driven by one of the level arms;

a shaft securely connected to the two ratchets, the shaft being driven by the lever arms to rotate in a direction constrained by the two ratchets; and a pulley securely connected to the shaft, wherein the air compressor has a 1 horsepower and feeds each of the two pneumatic pistons with a pressure of one hundred forty pounds per square inch, wherein each of the pneumatic pistons further has a displacement of about thirty millimeters, wherein each of the two pneumatic pistons is so configured that compressed air only contacts with one face of each of the two pneumatic pistons.

2. The mechanical impulse motor of claim 1, wherein each of the level arms further having a length of one meter.

3. The mechanical impulse motor of claim 1, wherein the shaft has a diameter of sixty millimeters.

4. The mechanical impulse motor of claim 1, wherein each of the two pulleys has a diameter of twenty four inches, and is connected to a system of pulleys resulting in a last pulley reaching 1800 rounds per minute in rotational speed.

* * * * *